US008858109B2

(12) United States Patent
Kudo

(10) Patent No.: US 8,858,109 B2
(45) Date of Patent: Oct. 14, 2014

(54) COSMETICS APPLICATORS

(75) Inventor: Saori Kudo, Gifu (JP)

(73) Assignee: Chongqing Jiatong University, Chongqing (CN)

( * ) Notice: Subject to any disclaimer, the term of this patent is extended or adjusted under 35 U.S.C. 154(b) by 960 days.

(21) Appl. No.: 12/562,884

(22) Filed: Sep. 18, 2009

(65) Prior Publication Data

US 2010/0224213 A1 Sep. 9, 2010

(30) Foreign Application Priority Data

Mar. 9, 2009 (JP) ..... 2009-054435

(51) Int. Cl.
*B43K 27/04* (2006.01)
*A45D 40/20* (2006.01)
*A45D 40/26* (2006.01)

(52) U.S. Cl.
CPC ..... *A45D 40/26* (2013.01); *A45D 40/20* (2013.01)
USPC ..... 401/35; 401/34; 401/198

(58) Field of Classification Search
USPC ..... 401/34, 35, 37, 38, 196, 198, 199; 110/108
See application file for complete search history.

(56) References Cited

U.S. PATENT DOCUMENTS

| | | | | |
|---|---|---|---|---|
| 3,442,595 | A * | 5/1969 | Dumas | 401/35 |
| 3,887,287 | A * | 6/1975 | Rosh, Jr. | 401/35 |
| 5,017,034 | A * | 5/1991 | Stary et al. | 401/35 |
| 5,119,838 | A * | 6/1992 | Nakazima | 132/108 |
| 5,154,193 | A * | 10/1992 | Busch et al. | 132/110 |
| 5,388,924 | A * | 2/1995 | Chao | 401/35 |
| 5,676,480 | A * | 10/1997 | Tosto | 401/10 |
| 6,120,202 | A * | 9/2000 | Donsky | 401/35 |
| 6,685,373 | B1 * | 2/2004 | Liu | 401/35 |
| 7,018,122 | B2 * | 3/2006 | Kwan et al. | 401/35 |
| 7,077,592 | B2 * | 7/2006 | Gueret | 401/128 |
| 7,997,820 | B2 * | 8/2011 | Bouix et al. | 401/35 |
| 2004/0253034 | A1 * | 12/2004 | Sieling et al. | 401/35 |
| 2009/0154983 | A1 * | 6/2009 | Khoshnevis | 401/34 |
| 2009/0257811 | A1 * | 10/2009 | Brachman | 401/34 |

FOREIGN PATENT DOCUMENTS

| | | |
|---|---|---|
| CN | 1164821 | 11/1997 |
| CN | 1199590 | 11/1998 |
| CN | 1439321 | 9/2003 |
| CN | 101828808 | 9/2010 |
| EP | 1938708 | 7/2008 |

(Continued)

OTHER PUBLICATIONS

SIPO, "Office Action," issued in connection with Chinese Patent Application No. CN200910161473.9, on Jul. 8, 2011 (4 pages).
INPI, "Search Report and Written Opinion," issued in connection with French Patent Application No. 0955252, on Feb. 23, 2012 (5 pages).

(Continued)

*Primary Examiner* — David Walczak
*Assistant Examiner* — Jennifer C Chiang
(74) *Attorney, Agent, or Firm* — Hanley, Flight and Zimmerman, LLC

(57) ABSTRACT

Cosmetics applicators are disclosed. An example cosmetics applicator includes a plurality of application bodies with front end portions, the front end portions protruding from a container and being capable of applying cosmetic materials, the plurality of application bodies extending in an axial direction, and where the plurality of application bodies are arranged in line, connected integrally by a melt-bonding portion, and collectively inserted with the melt-bonding portion into a cotton core within the container, the cotton core impregnated with the cosmetic materials.

4 Claims, 9 Drawing Sheets

(56) References Cited

FOREIGN PATENT DOCUMENTS

| | | |
|---|---|---|
| JP | 58073137 | 5/1983 |
| JP | H024504 | 1/1990 |
| JP | 3137562 | 6/1991 |
| JP | H0460117 | 5/1992 |
| JP | 10272883 | 10/1998 |
| JP | 2001038279 | 2/2001 |
| JP | 3137562 | 11/2007 |
| JP | 4829318 | 12/2011 |

OTHER PUBLICATIONS

Japanese Patent Office, "Notice of Allowance," issued in connection with Japanese Patent Application No. 2009-054435, on Sep. 8, 2011 (3 pages).

Japanese Patent Office, "Office Action," issued in connection with Japanese Patent Application No. 2009-054435, on Jan. 18, 2011 (2 pages).

Japanese Patent Office, "Restriction Requirement," issued in connection with Japanese Patent Application No. 2009-054435, on May 20, 2011 (2 pages).

* cited by examiner

COSMETICS APPLICATORS

FIELD OF THE DISCLOSURE

The present invention relates to cosmetics applicators.

BACKGROUND

Recently, a cosmetics applicator that draws an eye line by applying liquid cosmetic materials at an eyelash line is known from Japanese Utility Model Registration Publication No. 3137562. In the cosmetics applicator described in Japanese Utility Model Registration Publication No. 3137562, an elongated application body is accommodated inside a container from which a front end portion of the elongated application body protrudes. On the other hand, a rear end portion of the application body is inserted into a cotton core, which is accommodated in the container and impregnated with liquid cosmetic materials. Consequently, a construction is achieved which can suck up the liquid cosmetic materials by means of capillarity action and apply the materials from the front end portion of the application body.

In the cosmetics applicator, a plurality of application bodies are employed in parallel, or alternatively an application body having a plurality of the front end portions is used, in order to be capable of doting simultaneously at a plurality of positions between the adjacent eyelash roots so as to apply liquid cosmetic materials between the eyelash roots.

However, if a plurality of application bodies are employed in parallel in the above described cosmetics applicator, when the application bodies are inserted into the cotton core inside the container, the distances of insertion of the plurality of application bodies into the cotton core are different from each other due to the resistance of the cotton core. As a result, it is impossible for the front end portions of the application bodies to be positioned in alignment with each, and thus there is a problem in that the production efficiency is very poor. Furthermore, in the cosmetics applicator, in the case that an application body having a plurality of the front end portions, high technique for manufacturing the application bodies is required and thus it is difficult to the application body in technique.

Figure 1:
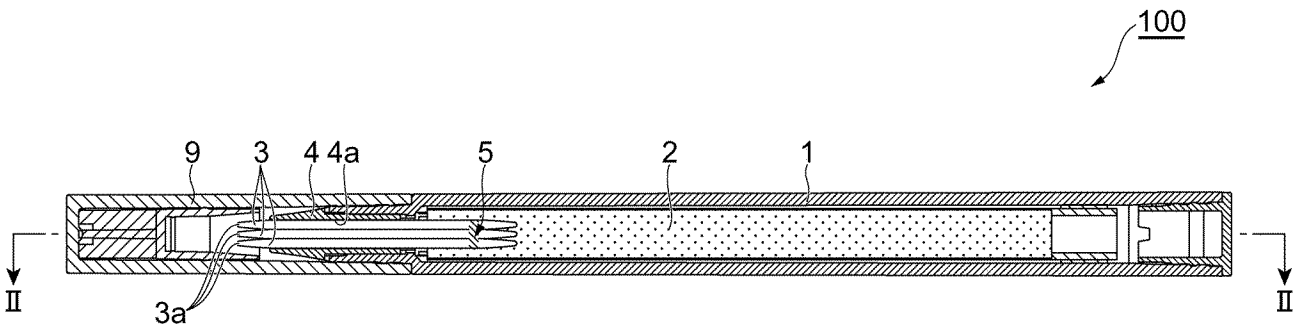
FIG. 1 is a longitudinal cross-sectional view showing a cosmetics applicator according to a first example.

The following is a key to the reference numerals employed in the Figures:

1: body cylinder (container)
2: cotton core
3: application body
3*a:* front end portion of the application body
4: sleeve(container)
5: melt-bonding portion(connection means)
6: connection member(connection means)
100, 300: cosmetics applicator

DETAILED DESCRIPTION

A preferred example cosmetics applicator will be described below with reference to FIGS. 1-9. In addition, like numerals depict like elements throughout the drawings, and repeated description will be omitted.

Figure 3:
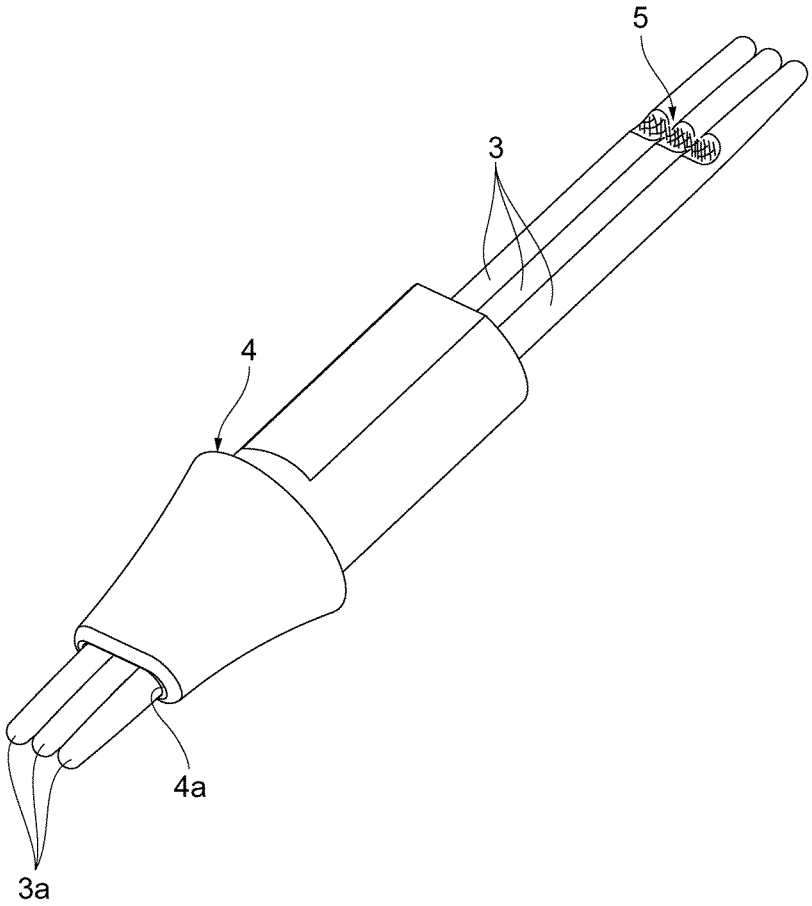
FIG. 3 is a perspective view showing the application body and the sleeve of FIG. 2 are drawn out.
Figure 4:
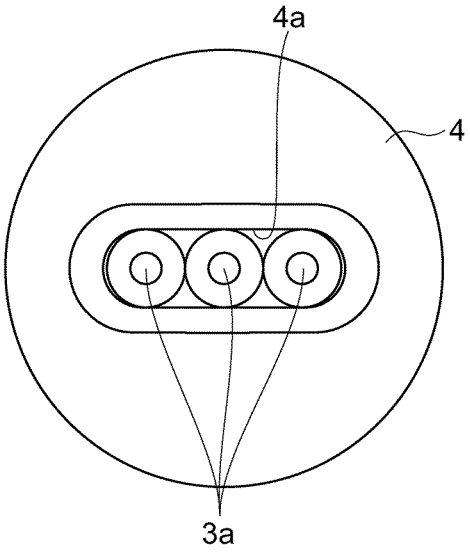
FIG. 4 is a front view of the application body and the sleeve shown in FIG. 3.
Figure 5:
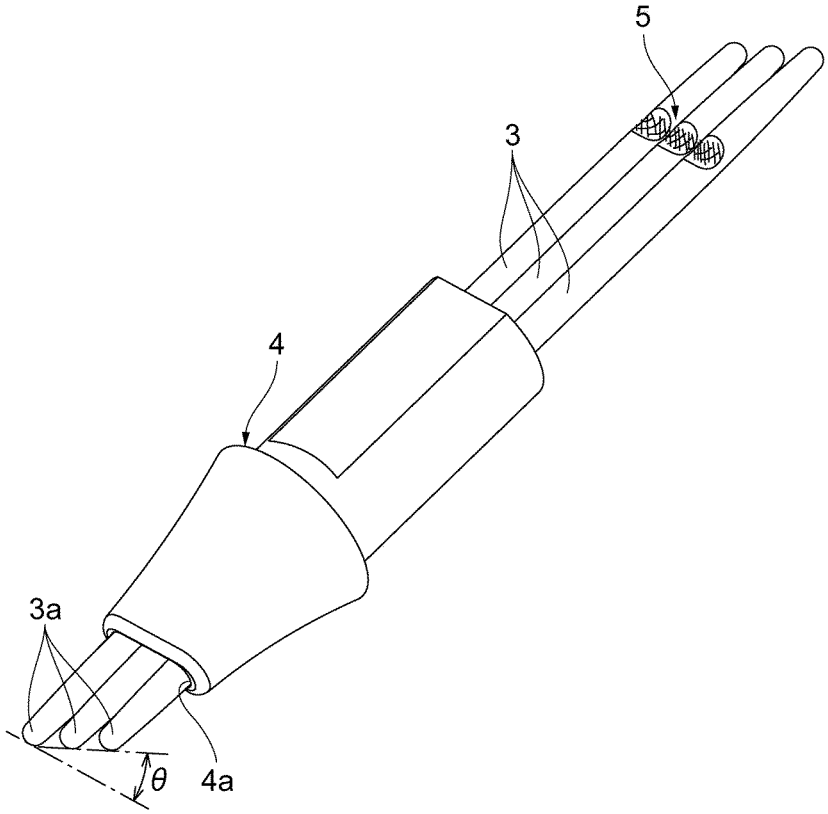
FIG. 5 is a perspective view showing the application body and the sleeve of the cosmetics applicator according to a second example.

FIGS. 1-4 show a first example applicator constructed pursuant to the teachings of the present invention, FIG. 5 shows a second example, and FIGS. 6-9 show a third example. First, the first example shown in the FIGS. 1-4 will be described.

Figure 2:
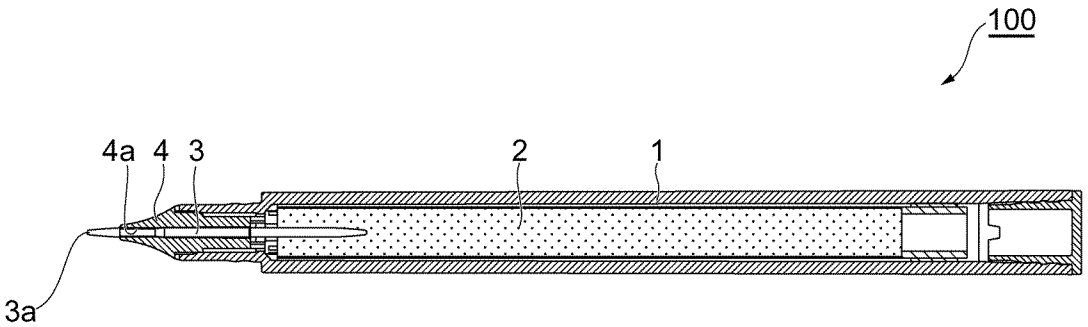
FIG. 2 is a view observed along the direction of arrow II-II of FIG. 1 with a cap being detached.

FIG. 1 is a longitudinal cross-sectional view showing a first example cosmetics applicator. FIG. 2 is a view observed along the direction of arrow II-II of FIG. 1 with a cap being detached. FIG. 3 is a perspective view with the application body and the sleeve of the FIG. 2 drawn out. FIG. 4 is a front view of the application body and the sleeve shown in FIG. 3. The cosmetics applicator 100 in this example is used for applying the liquid eyeliner used as cosmetic material at eyelash lines, so as to highlight the outline of the eyes.

As shown in FIGS. 1 and 2, in the cosmetics applicator 100, the rear half portions (presented in the right side of the drawings) of a plurality of elongated application bodies 3 extending in an axial direction are inserted into a cotton core 2. The cotton core 2 is accommodated in a cylindrical body cylinder 1 with bottom and is impregnated with liquid eyeliner. As shown in FIGS. 3 and 4, the above application bodies 3 are configured to extend through a long-circular cylinder hole 4*a* formed in a cylindrical sleeve 4 mounted in the front end of the body cylinder 1, and the front end portions 3*a* of the application bodies 3 protrude outwardly. The application bodies 3 suck up the liquid eyeliner from the cotton core 2 by means of capillarity action, thereby the liquid eyeliner can be applied from the front end portions 3*a* of the application bodies 3. In addition, the application bodies 3 herein are made of, for example, polyester, and three application bodies 3 are arranged in line. In addition, the exterior outline of the container is made up of the body cylinder 1 and the sleeve 4 etc. The container is made of, for example, PP (Polypropylene), and the cotton core 2 is made of, for example, polyester. In addition, as shown in FIG. 1, a cap 9 for protecting the front end portions 3*a* of the application bodies 3 is mounted on the front end of the container in a freely detachable manner.

Herein, the front end portions 3*a* of each application bodies 3 are arranged in parallel in such an interval that the front end portions 3*a* of each application bodies 3 can dot simultaneously at a plurality of portions (three portions in the embodiment) between adjacent eyelash roots as an applied portion. The interval is in the range of 0.9 to 1.5 mm, which is an average interval between adjacent eyelash roots of consumers.

In addition, particularly in the present example as shown in FIGS. 1 and 3, the plurality of application bodies 3 are connected integrally by a melt-bonding portion (a connection means). The melt-bonding portion is formed by melt-bonding. In the present example, the melt-bonding portion is disposed on rear end sides of the application bodies 3 without interfering with the position of assembling.

In this manner, according to present example, since the application bodies 3 each are connected integrally by the melt-bonding portion 5, the front end portions 3*a* can be aligned easily, and it would be otherwise very difficult for the front end portions to be aligned due to being subjected to a resistance from the cotton core 2 upon their insertion into the cotton core 2 in a disorderly state. And an operability of assembling is improved by the integration. As a result, the applicator can be fabricated easily and the manufacturing cost is reduced.

FIG. 5 is a perspective view showing the application body and the sleeve of a second example cosmetics applicator. FIG. 5 corresponds to FIG. 3.

The second example is different from the foregoing first example in that the front end portions 3*a* of the plurality of application bodies 3 are arranged obliquely in a sequentially staggered manner along the direction in which the application bodies 3 are arranged in parallel (up and down direction in FIG. 1), that is, the front end portion 3*a* are arranged obliquely in a sequentially staggered manner along a line which forms θ angle with the normal surface of the front end. However, the plurality of the application bodies 3 is connected integrally by the melt-bonding portion 5, as that in the first embodiment.

Naturally, the second example has the same function and effect as that of the first example. Furthermore, in such second example, when the application of cosmetic materials is performed in such a way that all the front end portions 3*a* of the plurality of application bodies 3 are in contact simultaneously with a plurality of portions between the eyelash roots as the applied portion (that is, doting simultaneously), the above cosmetics applicator applies the cosmetic materials obliquely toward the inclined direction of the arrangement of the front end portions 3*a*, rather than just opposite (perpendicular to) the eyes. As a result, it has the function and effect that a user would not be interfered by the cosmetics applicator when applying cosmetic materials while looking into the mirror, thereby the application of the cosmetic materials can be performed easily.

Figure 6:
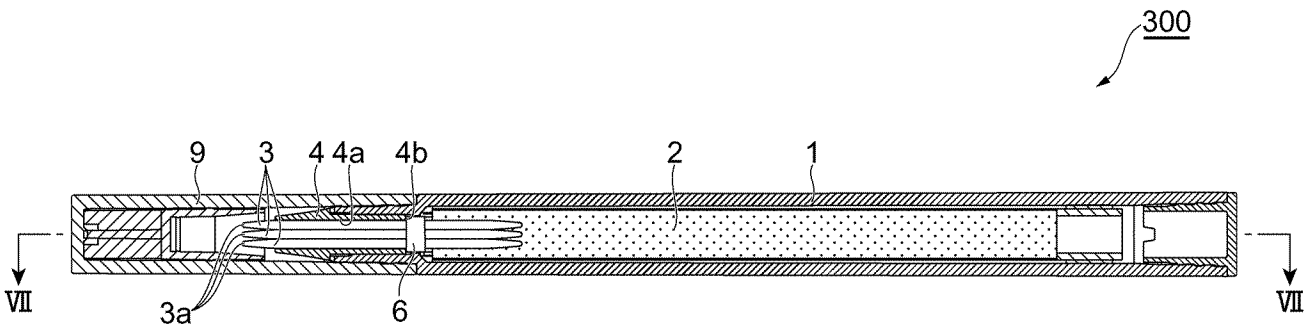
FIG. 6 is a longitudinal cross-sectional view showing the application body and the sleeve of the cosmetics applicator according to a third example.
Figure 7:
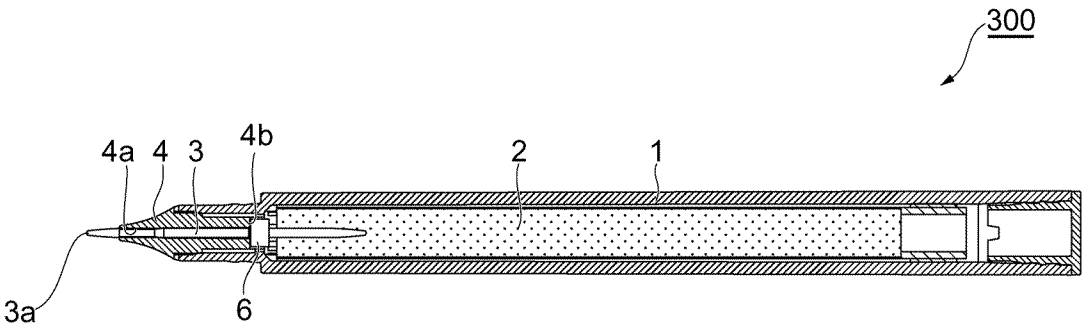
FIG. 7 is a view observed along the direction of arrow VII-VII of FIG. 6 with a cap being detached.
Figure 8:
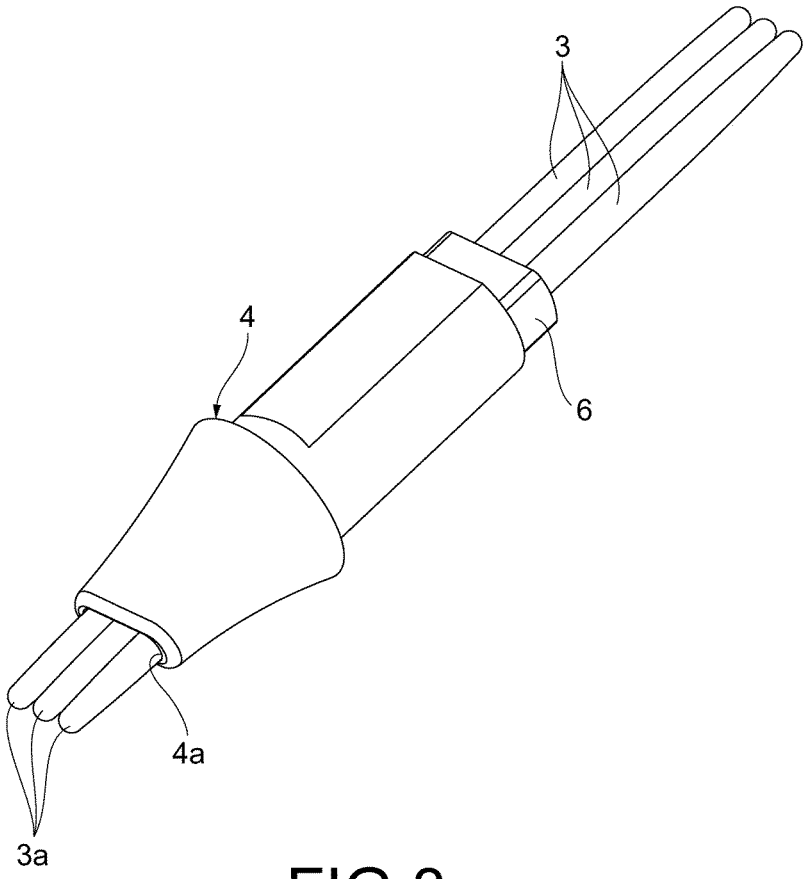
FIG. 8 is a perspective view showing the application body, the connection member and the sleeve of FIG. 7 are drawn out.
Figure 9:
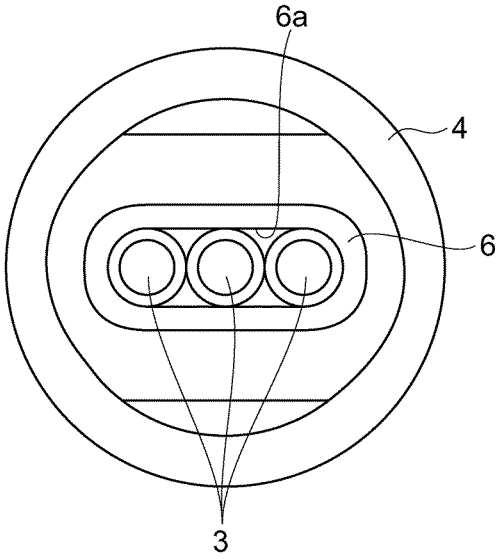
FIG. 9 is rear view of the application body, the connection member and the sleeve shown in FIG. 8.

FIG. 6 is a longitudinal cross-sectional view showing a third example cosmetics applicator. FIG. 7 is a view observed along the direction of arrow VII-VII of FIG. 6 with a cap being detached. FIG. 8 is a perspective view showing the application body, the connection member and the sleeve of FIG. 7 are drawn out. FIG. 9 is a rear view of the application body, the connection member and the sleeve shown in FIG. 8.

As shown in FIGS. 6 to 9, the third example cosmetics applicator 300 is different from the first example cosmetics applicator 100 in that the melt-bonding portion 5 is replaced with a connection member 6 for connecting the plurality of application bodies integrally.

The connection member 6 is formed in a cylindrical shape and is configured as a long circular profile. The connection member 6 has a long circular cylinder hole 6*a*. The application bodies 3 extend through the cylinder hole 6*a* respectively so as to be connected together. Herein, the connection member 6*a* is a heat-shrinkable tube. The so-called heat-shrinkable tube is a member which functions as follows: when heated in a state that the application bodies 3*a* extend through the cylinder hole 6*a*, the tube shrinks so as to connect the application bodies 3*a* together.

In addition, the structure of the connection member 6 is not limited to the heat-shrinkable tube, for example resin-molded product, metal pipe, or annular elastomer and the like can also be used. Specifically, in the case of resin-molded product, the application bodies 3 can be connected together by being pressed into the cylinder hole of the resin-molded product. In the case of metal pipe, the application bodies 3 can be connected together by being inserted into the cylinder hole of the metal pipe and by the following caulking of the metal pipe. In the case of annular elastomer, the application bodies 3 are inserted into the annular elastomer extended firstly, and thus the application bodies 3 can be connected together due to the contraction of the annular elastomer.

The third example wherein the plurality of application bodies 3 are connected integrally with the connection member 6 has the same function and effect as that of the first example. Moreover, if the connection member 6 is disposed in a predetermined position in the container by determining a connection position of the connection member 6 relative to the application bodies 3 in the axial direction beforehand, then the protruding length of the front end portions 3*a* of the application bodies 3 from the container (sleeve 4) is fixed. More specifically, as shown in FIGS. 6 and 7, if the connection member 6 is inserted into the sleeve 4 from an opening in the rear end of the sleeve 4, and positioned in such a way that the front end surface of the connection member 6 abuts against the stepped surface 4*b* of the sleeve 4, then the length of the front end portions 3*a* of the application bodies 3 protruding from the container (sleeve 4) is fixed. Consequently, the applicator can be fabricated more easily.

By the way, in the third example, the connection member 6 is employed. However, besides the connection member 6, the third example can also be configured such that the front end portions 3*a* of the plurality of application bodies 3 are arranged obliquely in a sequentially staggered manner along the direction in which the application bodies are arranged in parallel, just as that in the second embodiment.

In addition, as another example, it is preferably that at least one of the plurality of application bodies 3 is made of material different from that of other application bodies. The following problems could be eliminated with such configuration: if all the application bodies 3 are made of soft material in order to improve use feeling, then the strength of product will be reduced for example when the cosmetics applicator dropped, on the other hand, if all the application bodies 3 are made of hard material in order to improve the strength of product, then the use feeling will be deteriorated. For example, by having the application bodies in the midpoint or on both sides made from high strength material so as to improve the strength of product, and having at least one of the plurality of application bodies 3 made of material different from that of other application bodies, the strength of the product can be improved while keeping moderate use feeling. In addition, if application bodies of different material are combined together to be used as above, since each of the application bodies must be manufactured individually, advantageously the plurality of application bodies are connected integrally by the melt-bonding portion 5 or the connection member 6.

The present invention is not limited to the illustrated and described example. For instance, it has been described that the application bodies 3 are connected integrally by means of melt-bonding. However, the melt-bonding could be replaced with adhesive-bonding.

In addition, the connection member and the each of the application bodies can also be connected together by, for example, melt-bonding or adhesive-bonding and the like.

In addition, in the foregoing examples, it is particularly preferable that the cosmetics applicator is employed with liquid eyeliner used as the cosmetic materials. However, the cosmetics applicator can be employed with, for example, eyebrow line liquid used as the cosmetic materials. In invention described example a cosmetic application with a plurality of application bodies 3 is provided, wherein the plurality of application bodies 3 have front end portions 3*a* and extend in an axial direction, the front end portions 3*a* are protruding from a container and are capable of applying cosmetic materials.

The above described cosmetics applicators can be fabricated easily and with reduced manufacturing cost.

An example cosmetics applicator has a plurality of application bodies. The plurality of application bodies have front end portions which protrude from a container and are capable of applying cosmetic materials, and the plurality of the application bodies extend in an axial direction. The cosmetics applicator is characterized in that the plurality of application bodies are connected integrally by a connection means.

According to such cosmetics applicator, the application bodies each are connected integrally by a connection means, wherein the plurality of application bodies have front end portions which protrude from a container and are capable of applying cosmetic materials, and the plurality of the application bodies extend in an axial direction. Therefore, the front end portions can be aligned easily, and it would be otherwise very difficult for the front end portions to be aligned due to being subjected to a resistance from, for example, a cotton core upon their insertion into the cotton core in a disorderly state. And an operability of assembling is improved by the integration. As a result, the applicator can be fabricated easily and the manufacturing cost can be reduced accordingly.

Herein, as a structure functioning effectively as described above, the connection means is in a particularly example a melt-bonding portion by which the plurality of application bodies are connected integrally.

Furthermore, the connection means can be also a connection member by which the plurality of application bodies are connected integrally. In the case that such connection member is employed, if the connection member is disposed on a predetermined position in the container by determining beforehand a connection position of the connection member with respect to the application bodies in the axial direction, then the protruding length of the front end portions of the application bodies from the container is fixed. Consequently, the applicator can be fabricated more easily.

Furthermore, it is preferable that the front end portions of the plurality of application bodies are arranged obliquely in sequentially staggered manner along the direction in which the application bodies are arranged in parallel. If such an arrangement is employed, for example, in the case that the cosmetics applicator is used for applying cosmetic materials at a curved human feature such as an eyelash or eyebrow and the like, when the cosmetic materials are applied in such a way that all the front end portions of the plurality of application bodies are in contact with the applied portion simultaneously, the cosmetics applicator applies the cosmetic materials obliquely toward the inclined direction of the arrangement of the front end portions, rather than just opposite (perpendicular to) the eyes. As a result, a user will not be interfered by the cosmetics applicator when applying cosmetic materials while looking into the mirror, thereby the application of the cosmetic materials can be performed easily.

Furthermore, where at least one application body of the plurality of the application bodies is made of a material different from that of the other application bodies, the strength of product can be improved while keeping moderate use feeling due to the different material strengths.

In this way, the cosmetics applicator is provided, which can be fabricated easily, and of which the manufacturing cost is reduced.

It is noted that this patent claims priority from Japanese Patent Application Serial Number JP2009-054435, which was filed on Mar. 9, 2009, and is hereby incorporated by reference in its entirety.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A cosmetics applicator comprising a plurality of application bodies with front end portions, the front end portions protruding from a container and having tips which are capable of applying cosmetic materials, the plurality of application bodies extending in an axial direction, wherein the plurality of application bodies are arranged in line with intervals between central axes of the front end portions being 0.9 to 1.5 mm, connected integrally by a melt-bonding portion, and collectively inserted with the melt-bonding portion into a cotton core within the container, the cotton core impregnated with the cosmetic materials.

2. A cosmetics applicator according to claim 1, wherein the front end portions of the plurality of application bodies are arranged obliquely in a sequentially staggered manner along the direction in which the application bodies are arranged in parallel.

3. A cosmetics applicator according to claim 1, wherein at least one of the plurality of application bodies is made of a material different from that of other application bodies.

4. A cosmetics applicator according to claim 2, wherein at least one of the plurality of application bodies is made of a material different from that of other application bodies.

* * * * *